US007249938B2

(12) United States Patent
Noh et al.

(10) Patent No.: US 7,249,938 B2
(45) Date of Patent: Jul. 31, 2007

(54) LINEAR COMPRESSOR

(75) Inventors: Ki Won Noh, Seoul (KR); Jong Tae Her, Buchun-si (KR)

(73) Assignee: LG Electronics Inc., Seoul (KR)

( * ) Notice: Subject to any disclaimer, the term of this patent is extended or adjusted under 35 U.S.C. 154(b) by 0 days.

(21) Appl. No.: 11/165,381

(22) Filed: Jun. 24, 2005

(65) Prior Publication Data

US 2006/0060195 A1 Mar. 23, 2006

(30) Foreign Application Priority Data

Sep. 17, 2004 (KR) ..... 10-2004-0074526

(51) Int. Cl.
*F04B 17/04* (2006.01)
*F04B 35/04* (2006.01)

(52) U.S. Cl. ..... 417/417; 128/204.18; 92/171.1; 92/169.1

(58) Field of Classification Search ..... 417/417, 417/540, 551, 569, 570; 137/543.17
See application file for complete search history.

(56) References Cited

U.S. PATENT DOCUMENTS 6,398,523 B1 * 6/2002 Hur et al. ..... 417/417
6,676,388 B2 * 1/2004 Lee et al. ..... 417/417
6,835,052 B2 * 12/2004 Kim ..... 417/552
6,875,001 B2 * 4/2005 Song et al. ..... 417/417
6,913,450 B2 * 7/2005 Hong et al. ..... 417/545
6,960,067 B2 * 11/2005 Jung et al. ..... 417/417
7,025,575 B2 * 4/2006 Noh et al. ..... 417/363
7,028,601 B2 * 4/2006 Yoon et al. ..... 92/130 C

OTHER PUBLICATIONS

U.S. Appl. No. 11/191,902 to Kim, which was filed on Jul. 29, 2005.
U.S. Appl. No. 11/165,189 to Jung et al., which was filed on Jun. 24, 2005.

* cited by examiner

*Primary Examiner*—Patricia Bianco
*Assistant Examiner*—Nihir Patel
(74) *Attorney, Agent, or Firm*—Greenblum & Bernstein, P.L.C.

(57) ABSTRACT

Disclosed herein is a linear compressor. In the present invention, the configuration that a sealing protrusion is protruded in a sealing part of a cylinder toward an exhale cover leads line contact with the exhale cover and the sealing protrusion of the sealing part. Even though small power is applied to the exhale cover, the exhale cover and the sealing protrusion are closely adhered to each other, thus effectively sealing the exhale cover and the cylinder. Furthermore, as power transmitted from the exhale cover to the cylinder becomes reduced, a transformation of the cylinder can be prevented, and a performance and reliability of the linear compressor can be enhanced.

16 Claims, 5 Drawing Sheets

LINEAR COMPRESSOR

BACKGROUND OF THE INVENTION

1. Field of the Invention

The present invention relates to a linear compressor, more particularly, in which a sealing protrusion is formed in a cylinder for line contact with the cylinder and an exhale cover. With this configuration, the linear compressor provides a capability of improving its performance and reliability, by effectively sealing the cylinder and the exhale cover, and by preventing a transformation of the cylinder.

2. Description of the Related Art

Generally, a linear compressor is a machine to inhale, to compress, and to discharge fluid by linearly reciprocating a piston within a cylinder, by means of linear driving force of a linear motor.

FIG. 1 shows the linear compressor, in accordance with the prior art, and FIG. 2 shows a structure of an exhale part of the linear compressor, in accordance with the prior art.

In a hermetic casing 2 of the conventional linear compressor, a frame 4 connected to the cylinder 3 and a back cover 6 positioned in a rear of the frame 4 and provided with an inlet 5 are equipped. The frame 4 and the back cover 6 are upheld in the hermetic casing 2 by a main damper 7 and a subsidiary damper 8, so as to absorb a shock (see FIG. 1).

The linear motor 10 is mounted between the frame 4 and the back cover 6, which generates driving force to compress fluid.

The linear motor 10 is divided by a stationary part and a movable part. The stationary part includes an outer core 11, an inner core 12, and a coil 13 with a magnetic field. The movable part includes a magnet 14 that linearly reciprocates by magnetic force around the coil 13, and a magnet frame 15 which the magnet 14 is fastened to.

The piston 16 is set in the cylinder 3, which receives linear driving force from the magnet 14, linearly reciprocates, and compresses fluid within the cylinder 3.

In a rear of the piston 16, a flange 17 is formed to be fixed to the magnet frame 15. A main spring 18 is disposed between the flange 17 and the frame 4, and a subsidiary spring 19 is disposed between the flange 17 and the back cover 6, so that the piston 16 is elastically suspended.

The piston 16 is in a shape of a cylinder, which is open at its rear. An inhale passage 20 where fluid is entered is provided therein, and a plurality of inhale ports 21 is provided in its front.

In a front of the piston 16, there is an inhale valve 22 for opening and closing the inhale port 21. Fastened to the piston 16 by a connection member, the inhale valve 22 gets elastically bended, depending on a pressure difference between the inside and the outside of the inhale port 21, thus opening and closing the inhale port 21.

The cylinder 3 is in a shape of a cylinder, which is open at both sides, the piston 16 is inserted in one end, and the exhale part 30 for discharging compressed fluid is placed in the other end. The piston 16 and the exhale part 30 make a compression chamber C.

The exhale part 30 includes an inner exhale cover 32 located in a front of the compression chamber C of the cylinder 3 and provided with an exhale hole 31, an outer exhale cover 33 positioned at a regular interval from an outer surface of the inner exhale cover 32, and an exhale valve 34 elastically suspended in the inner exhale cover 32 to open and close the compression chamber C of the cylinder 3 (see FIG. 2).

The exhale valve 34 is suspended in the inner exhale cover 32 by an exhale spring 35. The exhale spring 35 is a coil spring to give the elasticity toward a direction that the exhale valve 34 closes the compression chamber C.

The inner exhale cover 32 is in a shape of a cap, so as to make an exhale space where fluid is discharged in the front of the compression chamber C of the cylinder 3. The outer exhale cover 33 is in a shape of the cap, so as to make a predetermined space, apart from the outer surface of the inner exhale cover 32 by predetermined distance.

In a circumference of the inner exhale cover 32, a main flange 36 is radially protruded, while in a circumference of the outer exhale cover 33, a subsidiary flange 37 is radially protruded to confront the main flange 36.

The main flange 36 and the subsidiary flange 37 respectively have a connection hole, fastened to the frame 4 by a bolt 38.

A connection groove 39 for connecting the bolt 38 is formed in a side of facing the main flange 36 in the frame 4.

A sealing part 40 is radially protruded in a circumference of the cylinder 3, confronting the main flange 36, so that fluid does not leak through a slit between the cylinder 3 and the inner exhale cover 32.

The linear compressor having the conventional structure of the exhale part operates in the following sequence.

In operation of the linear motor 10, the magnet 14 linearly reciprocates, its linear driving force is delivered to the piston 16 through the magnet frame 15. The piston 16 moves back and forth within the cylinder 3.

Fluid entered in the hermetic casing 2 is inhaled into the compression chamber C of the cylinder through the inhale passage 20 in the piston 16, is compressed by the piston 16, allows the exhale valve 34 to be opened, and is discharged to the outside through the inner exhale cover 32 and the outer exhale cover 33.

The inner exhale cover 32 and the outer exhale cover 33 are fastened to the frame 4 by the bolt 38. When the bolt 38 is tightened, the inner exhale cover 32 gives pressure to the sealing part 40 of the cylinder 3, and then the main flange 36 is closely adhered to the sealing part 40.

As a result, when the main flange 36 of the inner exhale cover 32 is closely adhered to the sealing part 40 of the cylinder 3, fluid is prevented against leaking between the inner exhale cover 32 and the cylinder 3.

However, in the linear compressor with the conventional exhale part, when the inner exhale cover 32 and the outer exhale cover 33 are connected to the frame 4, power is excessively delivered to the cylinder 3 through the inner exhale cover 32. It brings problems that the cylinder 3 may be transformed, and a gap between the piston 16 and the cylinder 3 may be transformed, thus reducing a performance and reliability of the linear compressor.

If power transmitted from the inner exhale cover 42 to the cylinder 3 gets reduced, in order to protect a transformation of the cylinder 3, the main flange 36 is not closely adhered to the sealing part 40. Therefore, fluid may leak between the inner exhale cover 32 and the cylinder 3.

SUMMARY OF THE INVENTION

Accordingly, it is an aspect of the present invention to provide a linear compressor which is capable of effectively sealing a cylinder and an exhale cover, and of preventing the cylinder from transforming.

The foregoing and other aspects are achieved by providing the linear compressor, based on the present invention, which comprises a frame connected to the cylinder, the exhale cover fastened to the frame, which covers an opening of the cylinder, and a sealing protrusion protruded either in the cylinder or in the exhale cover, for the purpose of line contact with the cylinder and the exhale cover.

A flange is radially protruded in the exhale cover, in order to be connected to the frame. A sealing part is protruded in a circumference of the cylinder, so as to face the flange.

The sealing protrusion is protruded either in the flange or in the sealing part toward another one.

The sealing protrusion is cylindrically formed in a shape of a ring.

A section of the sealing protrusion is in a shape of a circular arc.

The exhale cover includes an inner exhale cover having an exhale hole to discharge fluid drained from the cylinder, and an outer exhale cover positioned at a regular interval from an outer surface of the inner exhale cover.

The flange includes a main flange provided in the inner exhale cover, and a subsidiary flange in the outer exhale cover to confront the main flange.

The sealing protrusion is protruded in the sealing part toward the main flange.

The main flange and the subsidiary flange are connected to the frame by a bolt.

The main flange and the subsidiary flange respectively have a connection hole for connecting the bolt, and the frame has a connection groove.

According to the present invention providing the linear compressor, the sealing protrusion is protruded in the sealing part of the cylinder toward the exhale cover, thereby leading line contact with the exhale cover and the sealing protrusion of the sealing part. In spite of small power, the exhale cover and the sealing protrusion are closely adhered to each other, thus effectively sealing the exhale cover and the cylinder. Furthermore, as power transmitted from the exhale cover to the cylinder becomes reduced, a transformation of the cylinder can be prevented, and a performance and reliability of the linear compressor can be enhanced.

BRIEF DESCRIPTION OF THE DRAWINGS

These and other objects and advantages of the present invention will become apparent and more readily appreciated from the following description of the embodiments of the invention, taken in conjunction with the accompanying drawings of which.

DETAILED DESCRIPTION OF THE PREFERRED EMBODIMENT

Figure 1:
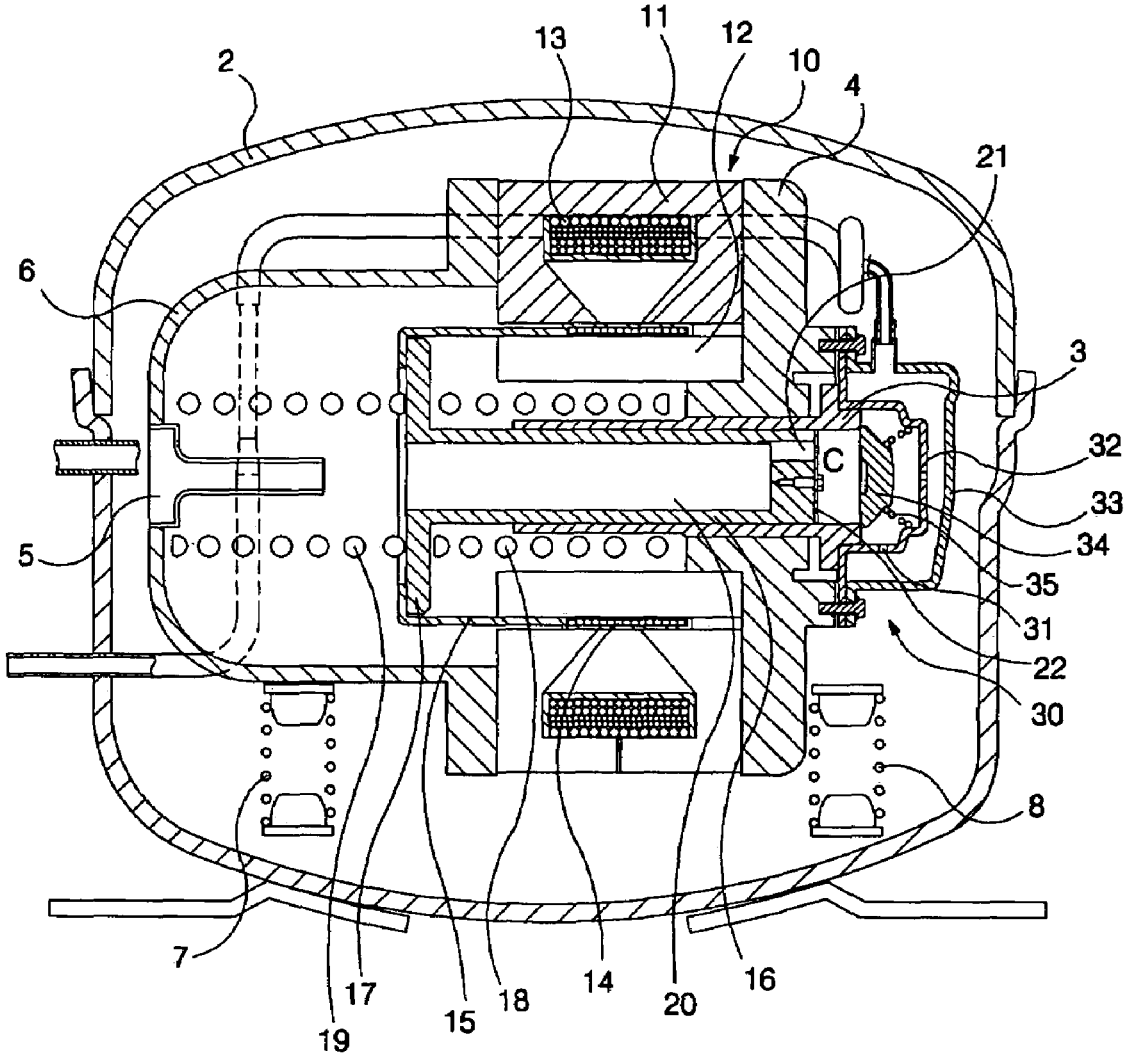
FIG. 1 (Prior Art)
FIG. 1 is a vertically sectional view of a linear compressor, according to the prior art.
Figure 2:
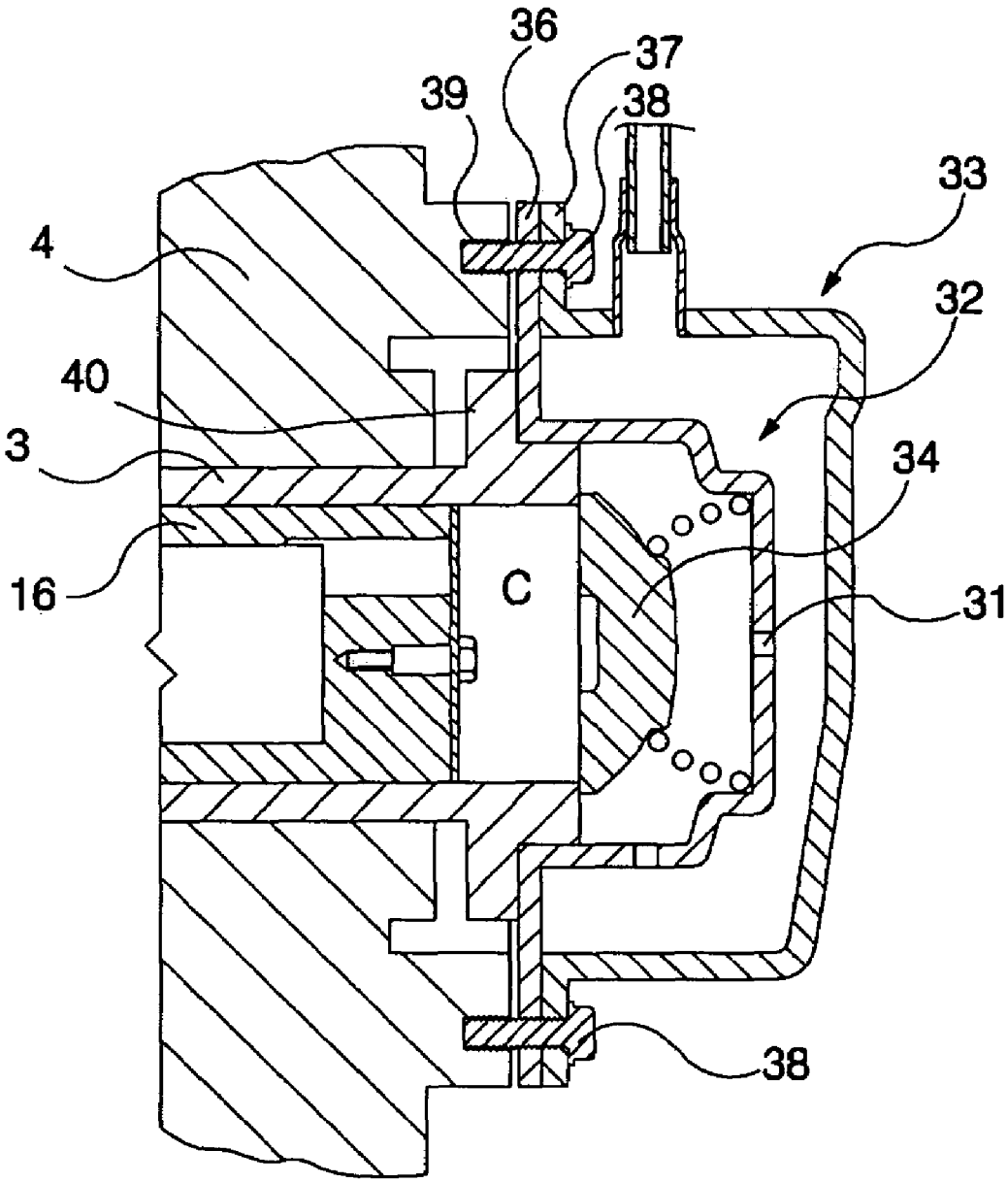
FIG. 2 (Prior Art)
FIG. 2 is a sectional view of a structure of an exhale part of the linear compressor, according to the prior art.

Reference will now be made in detail to the embodiments of the present invention, examples of which are illustrated in the accompanying drawings, wherein like reference numerals refer to the like elements throughout. The embodiments are described below in order to explain the present invention by referring to the figures.

Figure 3:
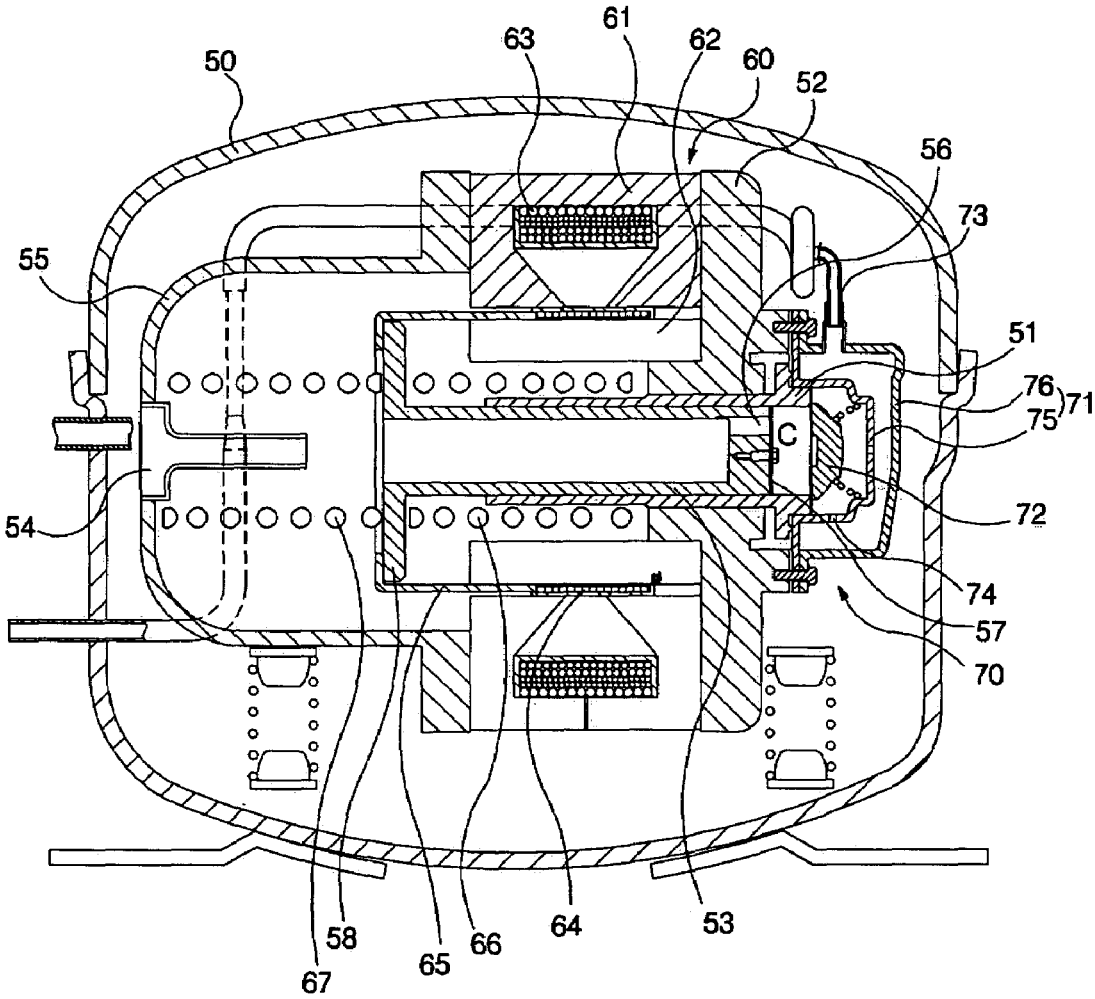
FIG. 3 is a vertically sectional view of the linear compressor, according to the present invention.
Figure 4:
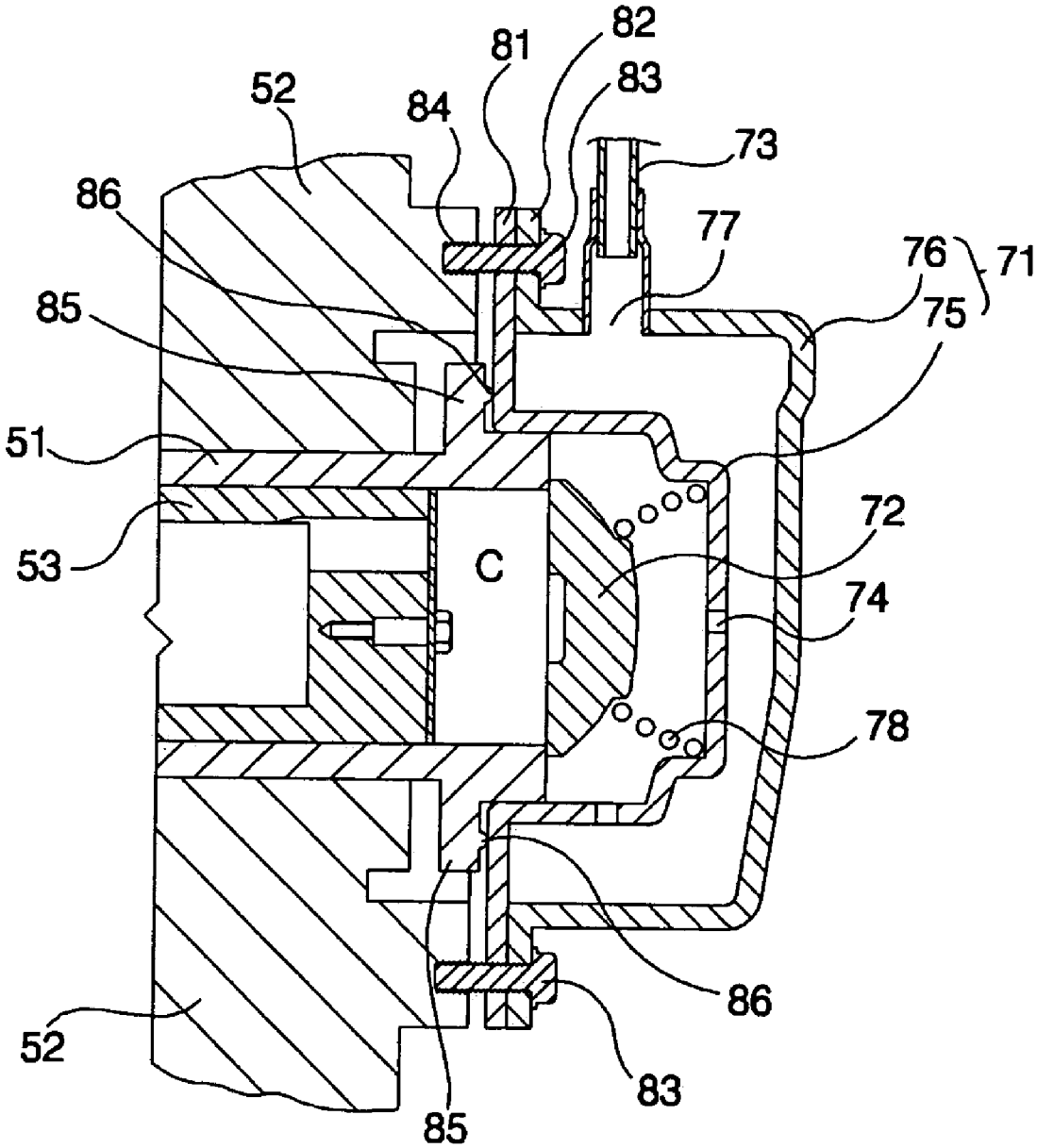
FIG. 4 is a sectional view of the structure of the exhale part of the linear compressor, according to the present invention.
Figure 5:
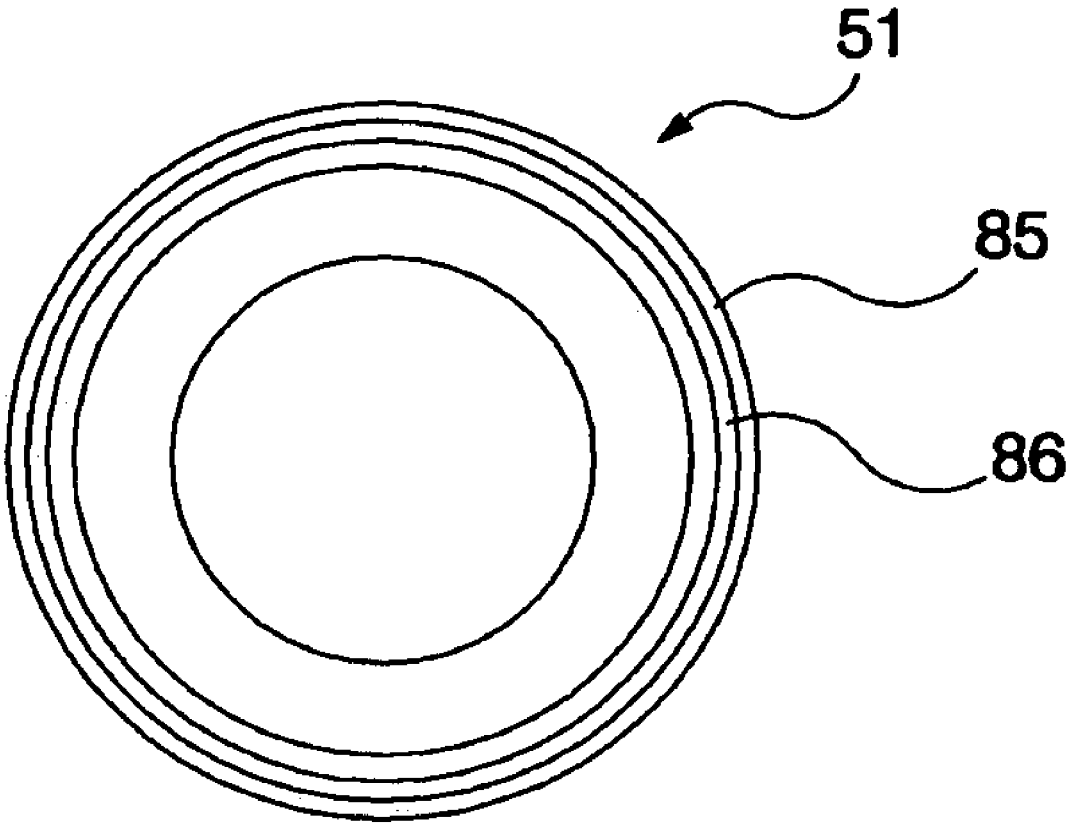
FIG. 5 is a front view of a cylinder, according to the present invention.

FIG. 3 shows a linear compressor, according to the present invention, FIG. 4 shows a structure of an exhale part of the linear compressor, according to the present invention, and FIG. 5 shows a cylinder.

As referring to FIGS. 3 to 5, the linear compressor, in accordance with the present invention comprises a hermetic casing 50, a linear motor 60 installed in the hermetic casing 50, a frame 52 set in the linear motor 60 and provided with the cylinder 51, a piston 53 set in the cylinder 51 to linearly reciprocate, by means of the linear motor 60, and the exhale part 70 positioned in a front of an opening of the cylinder 51 to discharge fluid compressed in the cylinder 51.

The frame 52 is mounted in a front of the linear motor 60, while a back cover 55 having an inlet 54 is mounted in a rear of the linear motor 60.

The linear motor 60 is divided by a stationary part and a movable part. The stationary part includes an outer core 61, an inner core 62, and a coil 63 with a magnetic field. The movable part includes a magnet 64 that linearly reciprocates by magnetic force around the coil 63, and a magnetic frame 65 which the magnet 64 is fastened to.

In one end of the cylinder 51, the piston 53 is inserted, and the other end is a cylindrical shape, which is open at both sides, so as to discharge compressed fluid. The piston 53 and the exhale part 70 make a compression chamber.

The piston 53 is in a shape of a cylinder. In a front, an inhale port 56 for inhaling fluid is placed, and an inhale valve 57 for opening and closing the inhale port 56 is fixed by a connection member like a bolt.

The piston 53 has a flange 58 in its rear, so as to be combined with the magnetic frame 65. As a main spring 66 is disposed between the flange 58 and the frame 52, and a subsidiary spring 67 is disposed between the flange 58 and the back cover 55, so that the piston 53 is elastically supported.

The exhale part 70 includes an exhale cover 71 covering the opening of the cylinder 51 and fastened to the frame 52, an exhale valve 72 elastically suspended in the exhale cover to open and close the opening of the cylinder 51, and a loop pipe 73 connected to the exhale cover 71 to discharge compressed fluid to the outside.

The exhale cover 71 includes an inner exhale cover 75 covering the opening of the cylinder 51 and provided with an exhale hole 74 to discharge fluid drained from the cylinder 51, and an outer exhale cover 76 positioned at a regular interval from an outer surface of the inner exhale cover 75.

An outlet 77 is perpendicularly formed to a direction of the piston 53 in the outer exhale cover 76. The loop pipe 73 is arranged in the outlet 77, so that compressed fluid is discharged to the outside of the hermetic casing 50.

The exhale hole 74 is respectively formed in a front and a circumference of the inner exhale cover 75. The exhale valve 72 is elastically held in the inner exhale cover 75 by an exhale spring 78 which is a conic coil spring to give the elasticity toward a direction that the exhale valve 72 closes the compression chamber of the cylinder 51.

The inner exhale cover 75 and the outer exhale cover 76 are in a shape of a cap. A main flange 81 is radially protruded in the inner exhale cover 75, so as to be combined with the frame 52. A subsidiary flange 82 is radially protruded in the outer exhale cover 76, so as to be combined with the main flange 81 and the frame 52 as well.

The main flange 81 and the subsidiary flange 82 are fastened to the frame 52 by a bolt 83, and have a connection hole for connecting the bolt 83 respectively.

A connection groove 84 for connecting the bolt 83 is formed at a corresponding position to the connection hole in the frame 52.

The inner exhale cover 75 covers a circumference of the cylinder 51. A sealing part 85 is radially protruded to face the main flange 81 in the circumference of the cylinder 51.

In order to prevent against a leakage of fluid through a slit between the cylinder 51 and the inner exhale cover 75, as the sealing part 85 is formed to confront the main flange 81, it is radially protruded along the circumference of the cylinder 51.

To be sealed by line contact with the cylinder 51 and the inner exhale cover 75, a sealing protrusion 86 is protruded either in the sealing part 85 or in the main flange 81. The case that the sealing protrusion 86 is formed in the sealing part 85 is explained as an example of the present invention.

The sealing protrusion 86 is protruded in the sealing part 85 toward the main flange 75, so as to be closely adhered to the main flange 75.

The sealing protrusion 86 is cylindrically formed in the sealing part 85 in a shape of a ring, its section is in a shape of a circular arc.

A process of the linear compressor having the exhale part, according to the present invention is described in the following.

When the linear motor 60 is in operation, the piston 53 linearly reciprocates within the cylinder 51.

When the piston 53 moves forward, fluid compressed within the cylinder 51 pushes the exhale valve 72, and compressed fluid is discharged to the inner exhale cover 75.

Fluid discharged to the inner exhale cover 75 is discharged to the outer exhale cover 76 through the exhale hole 74, and is discharged to the outside through the loop pipe 73.

Thereafter, when the piston 53 moves backward, the exhale valve 72 is closed by the stability of the exhale spring 78.

As the piston 53 moves back and forth in the cylinder 51, compressing and discharging fluid is repeated.

The exhale part of the linear compressor, based on the present invention is assembled as follows.

When the inner exhale cover 75 and the outer exhale cover 76 are connected to the frame 52 by the bolt 83, the main flange 81 of the inner exhale cover 75 gives pressure to the sealing part 85 of the cylinder 51. A space between the inner exhale cover 75 and the cylinder 51 becomes sealed.

Due to line contact with the inner exhale cover 75 and the sealing protrusion 86, power transmitted from the main flange 81 of the inner exhale cover 75 to the sealing part 85 of the cylinder 51 is focused on the sealing protrusion 86. Even though small power is applied to the inner exhale cover 75, the inner exhale cover 75 and the sealing protrusion 86 are effectively adhered to each other, and are sealed.

Since excessive power is not necessary for sealing, power from the inner exhale cover 75 to the cylinder 51 is reduced. It can prevent the cylinder 51 from transforming, caused by excessive power.

The operational effects of the linear compressor, according to the present invention are described in the following.

As apparent from the above description, the linear compressor of the present invention provides the sealing protrusion protruded in the sealing part of the cylinder toward the exhale cover, resulting in line contact with the exhale cover and the sealing protrusion of the sealing part. With small power, the exhale cover and the sealing protrusion are closely adhered to each other, thus effectively sealing the exhale cover and the cylinder. Furthermore, as power transmitted from the exhale cover to the cylinder becomes reduced, a transformation of the cylinder can be prevented, and a performance and reliability of the linear compressor can be enhanced.

Although a few embodiments of the present invention have been shown and described, it would be appreciated by those skilled in the art that changes may be made in this embodiment without departing from the principles and spirit of the invention, the scope of which is defined in the claims and their equivalents.

The present disclosure relates to subject matter contained in Korean Application No. 10-2004-0074526, filed on Sep. 17, 2004, the contents of which are herein expressly incorporated by reference in its entirety.

What is claimed is:

1. A linear compressor comprising:

a frame;

a cylinder;

wherein the frame is connected to the cylinder;

an exhale cover covering an opening of the cylinder and fastened to the frame; and a sealing protrusion protruded either in the cylinder or in the exhale cover, for line contact with the cylinder and the exhale cover, wherein a flange is radially protruded in the exhale cover, so as to be connected to the frame, and a sealing part is protruded in a circumference of the cylinder, so as to face the flange, and wherein the sealing protrusion is protruded either in the flange or in the sealing part toward another one.

2. The linear compressor as set forth in claim 1, wherein the sealing protrusion is cylindrically formed in a shape of a ring.

3. The linear compressor as set forth in claim 2, wherein a section of the sealing protrusion is in a shape of a circular arc.

4. The linear compressor as set forth in claim 3, wherein the exhale cover includes an inner exhale cover provided with an exhale hole that discharges fluid drained from the cylinder, and an outer exhale cover positioned at a regular interval from an outer surface of the inner exhale cover.

5. The linear compressor as set forth in claim 4, wherein the flange includes a main flange formed in the inner exhale cover, and a subsidiary flange formed in the outer exhale cover to confront the main flange.

6. The linear compressor as set forth in claim 5, wherein the sealing protrusion is protruded in the sealing part toward the main flange.

7. The linear compressor as set forth in claim 5, wherein the main flange and the subsidiary flange are combined with the frame by a bolt.

8. The linear compressor as set forth in claim 7, wherein the main flange and the subsidiary flange respectively have a connection hole that connects the bolt, and the frame has a connection groove.

9. A linear compressor comprising:

a hermetic casing; a linear motor installed in the hermetic casing;

a frame set in the linear motor and provided with a cylinder;

a piston which linearly reciprocates in the cylinder, by the linear motor;

an exhale cover covering an opening of the cylinder and fastened to the frame; and a sealing protrusion protruded either in the cylinder or in the exhale cover, for line contact with the cylinder and the exhale cover, wherein a flange is radially protruded in the exhale cover, so as to be connected to the frame, and a sealing part is protruded in a circumference of the cylinder, so as to face the flange, and wherein the sealing protrusion is protruded either in the flange or in the sealing part toward another one.

10. The linear compressor as set forth in claim 9, wherein the sealing protrusion is cylindrically formed in a shape of a ring.

11. The linear compressor as set forth in claim 10, wherein a section of the sealing protrusion is in a shape of a circular arc.

12. The linear compressor as set forth in claim 11, wherein the exhale cover includes an inner exhale cover provided with an exhale hole that discharges fluid drained from the cylinder, and an outer exhale cover positioned at a regular interval from an outer surface of the inner exhale cover.

13. The linear compressor as set forth in claim 12, wherein the flange includes a main flange formed in the inner exhale cover, and a subsidiary flange formed in the outer exhale cover to confront the main flange.

14. The linear compressor as set forth in claim 13, wherein the sealing protrusion is protruded in the sealing part toward the main flange.

15. The linear compressor as set forth in claim 13, wherein the main flange and the subsidiary flange are combined with the frame by a bolt.

16. The linear compressor as set forth in claim 15, wherein the main flange and the subsidiary flange respectively have a connection hole that connects the bolt, and the frame has a connection groove.

* * * * *